United States Patent [19]

Hartvig

[11] 4,241,530

[45] Dec. 30, 1980

[54] SIGN POST

[76] Inventor: Ole K. Hartvig, Motelvej 57, DK-400 Roskilde, Denmark

[21] Appl. No.: 12,365

[22] Filed: Feb. 15, 1979

[51] Int. Cl.[3] ..... G09F 15/00

[52] U.S. Cl. ..... 40/607; 40/610; 40/611; 248/223.1; 248/224.2

[58] Field of Search ..... 40/607, 610, 611, 612; 248/222.4, 223.1, 224.3, 224.4, 225.1, 225.2

[56] References Cited

U.S. PATENT DOCUMENTS

| | | | |
|---|---|---|---|
| 709,466 | 9/1902 | Butt | 40/611 |
| 1,455,103 | 5/1923 | Berry | 40/607 |
| 2,383,068 | 8/1945 | MacLean, Jr. | 248/222.4 X |
| 2,708,088 | 5/1955 | Steinke | 248/223.1 |
| 3,015,899 | 1/1962 | Ensign et al. | 40/607 |
| 3,392,848 | 7/1968 | McConnell et al. | 248/223.1 |
| 3,684,228 | 8/1972 | Sobel | 248/222.4 X |
| 4,115,966 | 9/1978 | DeLee | 40/607 X |
| 4,140,414 | 2/1979 | Buttgereit | 248/222.4 X |

FOREIGN PATENT DOCUMENTS

| | | | |
|---|---|---|---|
| 1524296 | 5/1968 | France | 248/222.4 |

*Primary Examiner*—John F. Pitrelli

*Assistant Examiner*—G. Lee Skillington

*Attorney, Agent, or Firm*—Watson, Cole, Grindle & Watson

[57] ABSTRACT

A sign post comprising vertically and horizontally extending frame elements which are mutually connected in order to form one or more compartments for accommodating signboards, wherein each of the horizontal frame elements, at the ends thereof, is provided with securing elements comprising recesses extending crosswise with respect to the longitudinal direction of the horizontal frame elements, each vertical frame element has a hollow profile and is in a side wall provided with openings for accommodating the securing elements of the horizontal frame elements in such a way that the recesses of the securing elements are arranged inside the vertical frame element or elements, a locking rail is provided for each vertical frame element, the locking rails being provided with openings of such a form that they allow accommodation of the securing elements accommodated in the openings of the corresponding element and movement of the locking rail with respect to the securing elements in such a way that wedge elements of the locking rail are insertable into the recesses of the securing elements.

3 Claims, 9 Drawing Figures

SIGN POST

BACKGROUND OF THE INVENTION

The present invention relates to sign posts comprising vertically and horizontally extending frame elements which are mutually connected in order to form one or more compartments for accommodating signboards.

Sign posts of this kind are known wherein the vertically and horizontally extending frame elements are welded together and are provided with welded lugs which extend into the compartments and are provided with holes in such a way that signboards may be secured in the compartments by means of bolts which extend through the holes in the signboards and the holes in the lugs.

Known sign posts of this kind in form of road sign posts and also in the form of city sign posts are available having widths which vary from 1000 to 2500 mm with intervals of 250 mm and having heights which vary according to whether the sign post is to comprise one, two, three or four signboards each having a height of 330 mm. Moreover, low road sign posts and city sign posts are available also having widths which vary from 1000 to 2500 mm with intervals of 250 mm and comprising one or two signboards having a height of 600 mm. Moreover, low two-legged gallows for information sign posts are known having widths which vary from 1000 to 2500 mm also with intervals of 250 mm and the heights of which vary from 1000 to 2000 mm with intervals of 250 mm. Accordingly, eighty-six different types of sign posts must be available in order to replace damaged signs on short notice. Moreover, when vehicles collide with welded posts of the known kind referred to above, such collisions will almost always result in damage of the signboards because only a minor bend of a single frame element will cause damage to the signboards due to the bolt connections between the signboards and the welded frame elements.

It is an object of the present invention to provide a sign post of the kind referred to above which, in a simple way, may be constructed from standardized frame elements in such way that equal frame elements may be used for constructing a plurality of different posts having different sizes so that a considerable reduction of articles in stock may be achieved. Calculations made on the basis of the present invention proves that only eighteen different types of frame elements are necessary in order to build the eighty-six different types of posts referred to above. This is due to the fact that if the sign posts are constructed from standard frame elements, frame elements of equal kind may be used in order to build different posts. This applies in particular as regards the horizontal frame elements which define the compartments wherein the signboards are to be arranged. However, it is a condition for such rationalization of sign posts that the frame elements of the posts may easily be connected in a reliable and rigid way.

SUMMARY OF THE INVENTION

According to the present invention such object is achieved in that each of the horizontal frame elements, at the ends thereof, is provided with securing means comprising recesses extending crosswise with respect to the longitudinal direction of the horizontal frame elements, that each vertical frame element has a hollow profile and in a side wall is provided with openings for accommodating the securing means of the horizontal frame elements in such a way that the recesses of the securing means are arranged inside the vertical frame element or elements and that a locking rail is provided for each vertical frame element, the locking rails being provided with openings of such a form that they allow accommodation of the securing means accommodated in the openings of the corresponding element and movement of the locking rail with respect to the securing means in such a way that wedge means of the locking rail are insertable into the recesses of the securing means. According to the invention only horizontal frame elements having lengths varying from 1000 to 2500 mm, i.e., horizontal frame elements of seven different lengths and only vertical frame elements of eleven different lengths are necessary in order to construct posts of the kind referred to above and, accordingly, the number of articles which must be available may be reduced from eighty-six different sign posts to eighteen different frame elements. Accordingly, it is possible, immediately after damage of a sign post has been reported, to send out a team which immediately may bring the frame elements necessary in order to repair the damaged post in question and, in case of minor damage, it will often be necessary only to replace some of the frame elements of the damaged post, seeing that the construction of the frame elements characteristic for the present invention as characterized above, allows an easy separation of the frame elements, replacing of damaged frame elements and an easy re-assembling, which is due to the fact that all horizontal frame elements may be secured to a corresponding vertical frame element or be disengaged with respect thereto solely by a longitudinal movement of the locking rail in the vertical frame element in question. Due to the very limited number of different frame elements, the team moreover may bring a sufficient number of frame element in order to, in situ, construct any post of the kind referred to above. Accordingly, it is no longer necessary to examine a damaged post in advance and then to send for a substitute from a remote storage location.

According to an embodiment of the present invention the wedge-accommodating recesses may have a tapering corresponding to the tapering of the wedge means. By means of such embodiment a very rigid connection between the horizontal and vertical frame elements is achieved.

According to a preferred embodiment of the sign post according to the invention the sign post is characterized in that each securing means comprises a foot, a body and a cross piece extending transversely with respect to the body, wherein the gaps between the cross piece and the foot form the wedge-accommodating recesses, and in that each of the openings of the corresponding locking rail consists of a part having the same form as the cross piece and a laterally directed part with respect to the noted part, the width of which corresponds to the width of the body, and that at each side of the laterally directed part of the opening, wedge means are provided formed by embossments in the locking rail. According to this latter embodiment, a two-sided securing of the securing means of the horizontal frame elements is achieved and, accordingly, a high degree of rigidity of the sign post.

A still further embodiment of the sign post is according to the present invention characterized in that each securing means consists of a U-shaped plate, the bottom portion of which forms the body of the securing means and each branch of which comprises oppositely arranged laterally directed cut-outs for forming the wedge accomodating recesses whereby the cut-out in the two branches are mutually off-set in order to provide the tapering of the recesses. This embodiment is advantageous in that the securing means may easily be produced by punching and bending sheet material.

In connection with the known sign posts mentioned above, it frequently happens that the signboards are heavily deformed by damage of the sign posts, which is due to the rigid connection between the sign post and the signboard or the signboards. According to a preferred embodiment of the invention each of the horizontal frame elements comprises a longitudinally extending slot in the oppositely arranged side walls of the horizontal frame elements for accommodating resilient strip formed board fasteners, each comprising a groove for engaging the adjacent edge of the corresponding signboard and a body for accommodation in the corresponding slot. By means of such embodiment a deformation of the frame elements will be transferred to the signboard or the signboards at a highly reduced degree and, accordingly, the risk of damaging the signboard or signboards will be reduced. In order to reduce the forces which will be transferred to the signboards in case of deformation of the sign post, the grooves of the strips may, according to a preferred embodiment of the sign post, be provided in the part of the strip projecting from the slot.

Further features of the invention will be apparent from the following detailed description of various embodiments.

DESCRIPTION OF THE PREFERRED EMBODIMENTS

Figure 1:
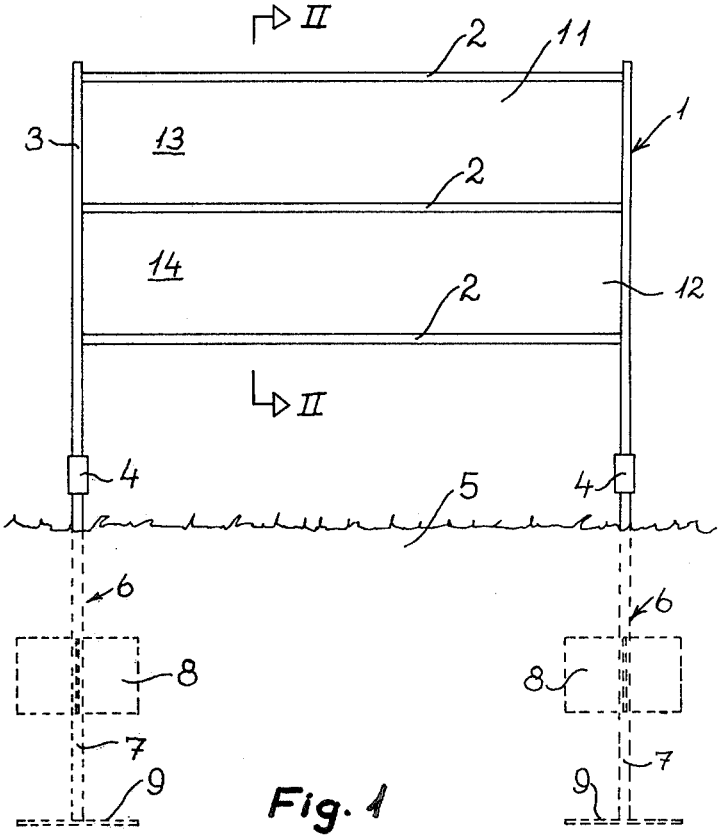
FIG. 1 shows in schematic fashion a front view of an embodiment of the sign post according to the present invention.

In the drawing, 1 designates a sign post consisting of horizontal frame elements 2 and vertical frame elements 3. By means of couplings 4,4 the vertical frame elements 3 are connected with fixtures 6 embedded in the ground 5. The fixtures consist of tubes 7 to which lugs 8 and 9 are secured by welding.

According to the embodiment shown in FIG. 1, the sign post comprises three horizontal frame elements 2 and two vertical frame elements 3 which together define two rectangular compartments 11 and 12 for accommodating signboards 13 and 14 provided with text or signs. The horizontal frame elements 2 are available from stock in different standard lengths and the same applies with regard to the vertical frame elements 3, viz., according to the widths and the heights of the signs to be built and according to how many compartments and what signboard heights are requested. Due to the fact that the vertical frame elements can be used regardless of how long the horizontal frame elements are, and due to the fact that the horizontal frame elements may be used regardless of how high the vertical frame elements 3 are and regardless of the number of compartments to which the vertical frame elements are arranged, it will be understood that the number of different sizes of frame elements on needed hand in order to construct sign posts of very varying sizes is extremely low.

Figure 8:
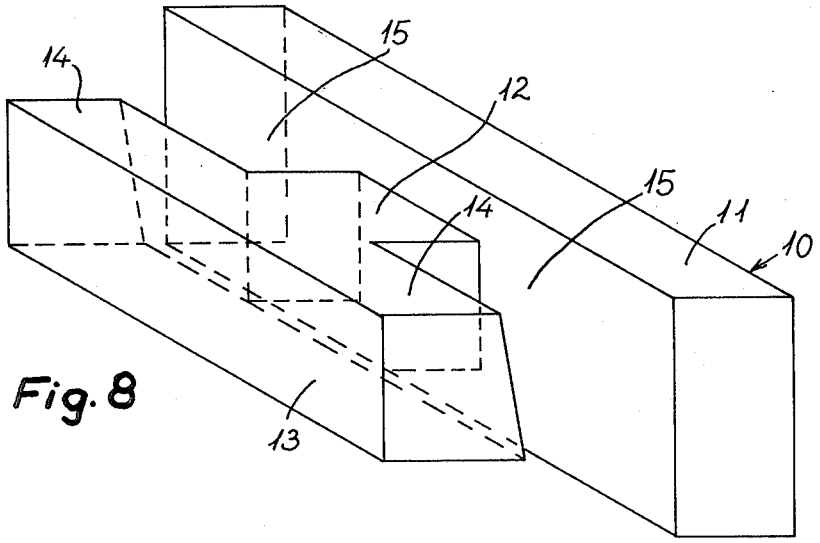
FIG. 8 shows a perspective view of an embodiment of a securing means for the sign post.
Figure 9:
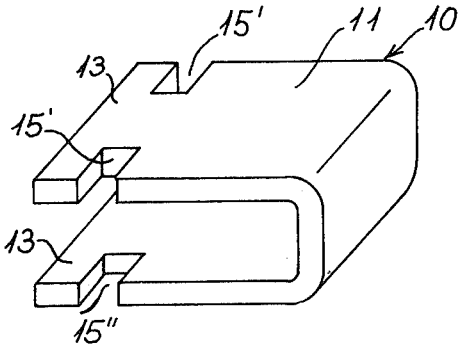
FIG. 9 shows a perspective view of another embodiment of the securing means.

In order to achieve the rationalization or simplification mentioned above with regard to the number of elements needed on hand in order to build a broad selection of posts, the horizontal and the vertical frame elements 2 and 3 must be easily connectable and disconnectable. In order to achieve this object a securing member 10 is secured to each end of each horizontal frame element. In FIGS. 8 and 9 two embodiments of such securing member are illustrated. The securing member 10 shown in FIG. 8 consists of a foot 11 formed as a rectangular block which can be inserted into the end of the corresponding horizontal frame element 2 which is hollow and in the embodiment shown has a rectangular cross section. The securing member in FIG. 8 also comprises a body part 12 having a smaller height and a smaller width than the foot 11 and a cross piece 13 is secured to the end of the body part 12. The ends 14 of the cross piece project laterally with respect to the body part 12 in such a way that recesses 15 are formed between the ends 14 and the foot 11. The side surfaces of the projecting ends 14 of the cross piece 13 which face the foot 13 slope downwardly towards the foot 11 in such a way that the recesses 15 taper wedge formed downwardly.

One securing member 10 is secured at each end of the horizontal frame elements 2, and in the side walls of the hollow vertical frame elements 3 facing each other, openings 17 are provided having rectangular form, viz., corresponding to the vertical cross section of the cross piece 13. The openings 17 are provided at the positions where the horizontal frame elements 2 are to be secured. Accordingly, it will be understood that the cross piece 13 of a securing member 10 may be inserted into a corresponding opening in a vertical frame element 3 in such a way that the cross piece 13 and a part of the body 12 extend into the interior of the vertical frame element and in such a way that the foot 10 contacts the outer surface of the corresponding side wall of the vertical frame element flush with the adjacent end of the corresponding horizontal frame element, as it appears from FIG. 3.

Figure 6:
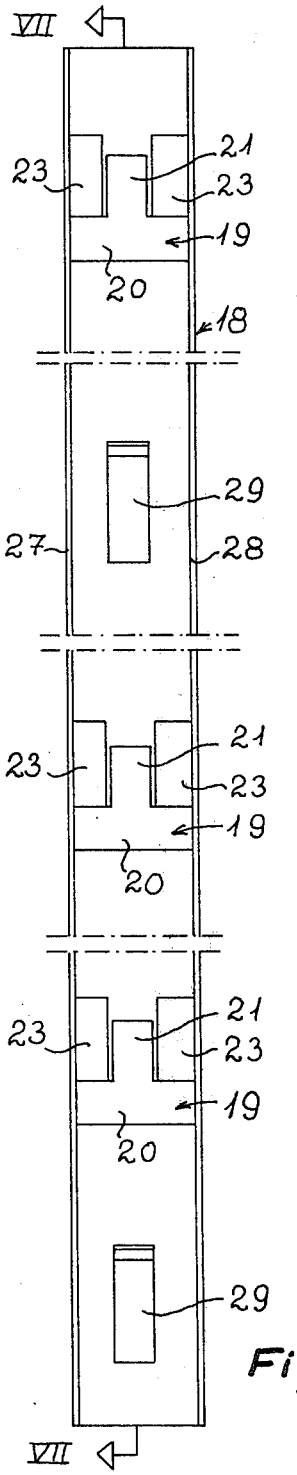
FIG. 6 shows a front view of a locking rail for the sign post shown in FIG. 1.
Figure 7:
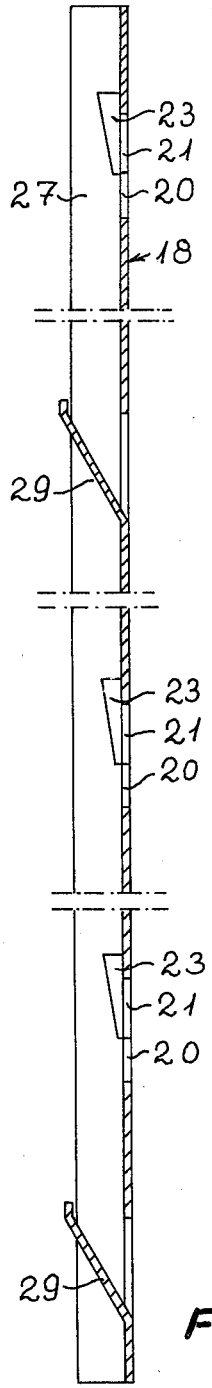
FIG. 7 shows a section according to section line VII—VII in FIG. 6.

In each of the vertical frame elements 3 a locking rail 18 (see FIGS. 6 and 7) is provided. In each locking rail openings 19 are cut out, each comprising a rectangular part 20 and a part 21 which is laterally directed with respect to the part 20. The form of the parts 20 of the openings corresponds to the form of the openings 17 in the side wall of the vertical frame element and, accordingly, also to the vertical cross section of the cross pieces 13 in such a way that the cross pieces 13 may be inserted through the openings 17 and the opening parts 20 when the latter are positioned so as to register with the openings 17. The width of the opening parts 21 corresponds to the width of the bodies 12 of the securing members and, accordingly, it will be understood that the rail 18, after inserting the cross piece of a securing member through an opening 17 in a vertical frame element 3 and an opening part 20 arranged in register therewith, may be pushed downwardly whereby the bodies 12 of the securing members will be accommodated in the opening parts 21. The locking rail 18 is, laterally with respect to the opening parts 21, provided with wedge-shaped cam means 23 which point downwardly and, accordingly, by moving a locking rail as explained above, such wedge means will enter into the recesses 15 between the cross piece and the foot of the securing members whereby the securing members 10 and, accordingly, also the corresponding horizontal frame elements will be locked and secured with respect to the corresponding vertical element.

On the other hand, such locking may easily be released by moving the locking rail 18 (in upward direction in FIG. 3) whereby the wedge means will be withdrawn from the recesses 15 and the opening parts 20 will be positioned in register with the openings 17 in the vertical frame element 3, whereby the horizontal frame elements may be withdrawn.

Each locking rail extends from the top of the corresponding frame element 3 and downwardly such a distance that the locking rail can lock the lowermost horizontal frame element to be connected with the vertical frame element in question. At the upper end each locking rail is secured to the bottom of a cup formed cap which is arranged in inverted position and the skirt 26 of which fits about the circumference of the corresponding vertical frame element. Such cap is used as maneuvering member for the corresponding locking rail and locking may be caused by blows directed towards the upwardly facing bottom of the cap and releasing may be caused by blows upon the downwardly facing edge of the cap whereby the corresponding locking rail will be moved upwards.

The locking rails have U-formed cross section with the bottom facing that side of the corresponding vertical frame element 3 wherein the opening 17 are provided. The side flanges 27,28 of the U-formed locking rails are a little narrower than the internal width of the corresponding vertical frame elements 3 in order to avoid jamming. By punching, tongues 29 are formed in the bottom of the locking rails and the tongues are bent inwardly and contact with their end the inner surface of the corresponding vertical frame elements 3 in the inserted position of the locking rail in question in such a way that the bottom of the locking rail is maintained closely adjacent the opposite side of the vertical frame element 3, viz., that side wherein the opening 17 are provided and in such a way that the wedge means are positively guided and according find their way into the recesses 15 by the movement of the locking rail.

According to the embodiment illustrated on the drawing, the wedge means consists of wedge formed blocks secured by welding to the inner surface of the bottom of the locking rail and laterally with respect to the opening parts 21. However, such wedge means may also consist of wedge-formed bosses on the bottom of the locking rail, whereby the production of the locking rails is simplified.

According to the embodiment illustrated in FIG. 9, the securing member 10 is manufactured from a piece of sheet material bent to U-form. The bottom part 11' of the securing member serves as a foot corresponding to the foot 11 illustrated in FIG. 8 and is adapted to be inserted into and to be secured to the end of the corresponding horizontal frame element. In each of the branches of the U-formed securing member two oppositely arranged laterally extending cut-outs are provided of which only the two cut-outs 15' belonging to the uppermost branch are shown in FIG. 9 and of which only one, 15'', of these cut-outs in the lowermost branch is visible in FIG. 9. The two pairs of laterally directed cut-outs serve the same object as the recesses 15 according to the embodiment shown in FIG. 8. The lateral cut-outs 15'' in the lowermost branch are narrower than the lateral cut-outs 15'' in the uppermost branch and the edges of the cut-outs nearest the bottom of the securing member are arranged flush with each other. Accordingly, it will be understood that the opposite side edges of the cut-outs 15' and 15'' have different distances from the bottom of the securing member and, accordingly, define sloping contact surfaces for the wedge means of the corresponding locking rail. Also it will be understood that the tapering in the downward direction of the cut-outs 15 in FIG. 8 corresponds to the tapering of the wedge means and, moreover, the difference in width between two above each other positioned cut-outs 15' and 15'' in FIg. 9 corresponds to the tapering of the corresponding wedge means. By securing the securing member 10 in FIG. 9 at the end of the corresponding horizontal frame element, the securing member is arranged in such a way that the side edges of the cut-outs 15', 15'' positioned nearest the bottom of the securing member, extend flush with the end edge of the corresponding horizontal frame element.

Figure 2:
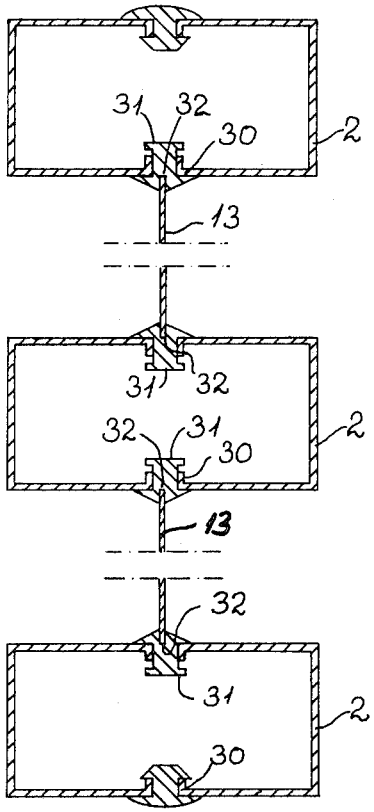
FIG. 2 shows a section according to the section line II—II in FIG. 1 on an enlarged scale.

As it appears from FIG. 2, a longitudinally extending slot is provided in each of the side walls of the horizontal frame elements 2 which face each other. The longitudinal extending slots 30 serve to accomodate resilient strip-formed holders 31 for signboards. In each of the strips a groove 32 is formed wherein the adjacent edge of a signboard 13 belonging to the compartment in question is positioned. In order to reduce transfer of forces between the horizontal frame elements 2 and the signboards 13, the strips 31 are provided with a bead which projects with respect to the corresponding frame element and wherein the corresponding groove is arranged in such a way that the signboards are supported outside the frame elements 2.

A sign post according to the present invention is assembled in the following way:

In the strip 31 of the uppermost or the lowermost horizontal frame element 2, one of the longitudinally extending edges of a signboard is inserted, which is to be positioned in the compartment bordered by the horizontal frame element in question. Then the next horizontal frame element is arranged, which may be formed as the central element shown in FIG. 2, seeing that the groove in one of the strips of this element is arranged around the opposite edge of the signboard in question. Now the edge of the next signboard is inserted in the opposite strip of the horizontal frame element in question and the procedure is continued in this way until all the signboards have been arranged and the lowermost or uppermost horizontal frame element 2 has been positioned.

The signboards and the horizontal frame elements are now adjusted so that their ends are flush with each other and the uppermost and the lowermost frame elements are pressed towards each other in such a way that the edges of the signboards are pressed into the grooves 32. The distance between the horizontal frame elements is now exactly such that the securing members at the ends of the frame elements can be inserted into the openings 17 in the corresponding vertical frame elements 3, with the locking rails arranged in such a position that the opening parts 20 therein are positioned opposite the openings 17 in the corresponding frame elements. When the securing members have been inserted through the openings, the corresponding rail is moved whereby the wedge means of the rail enter the recesses in all the securing members inserted in the frame element in question and thereby a secure locking of the horizontal frame elements is achieved.

Figure 3:
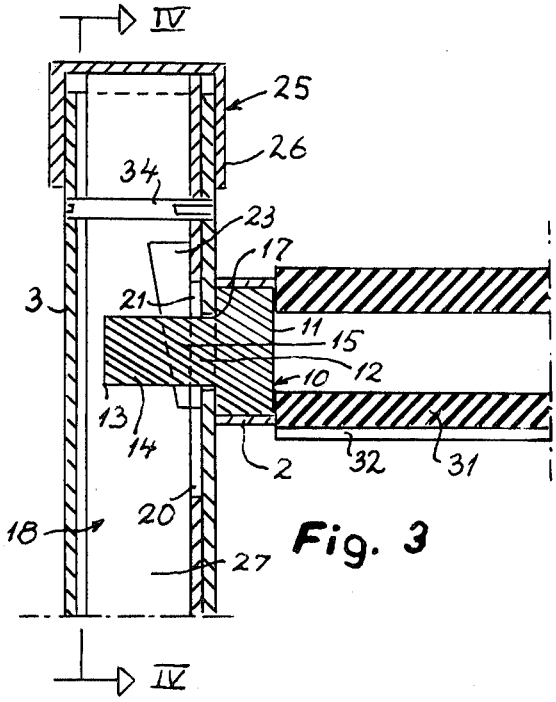
FIG. 3 shows a vertical section of the uppermost left hand corner of the sign post shown in FIG. 1.
Figure 5:
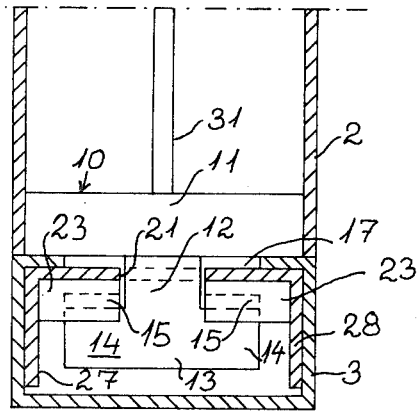
FIG. 5 shows a section according to section line V—V in FIG. 4.
Figure 4:
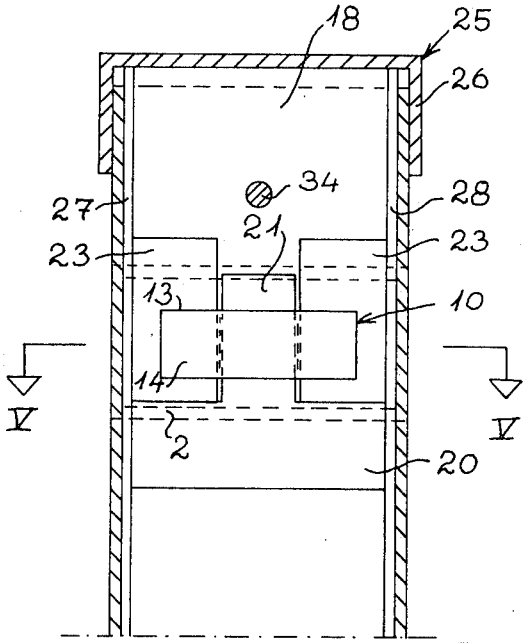
FIG. 4 shows a section according to section line IV—IV in FIG. 3.

In order to lock the locking rail in the locked position, a locking screw 34 may be arranged below the cap 25 as shown in FIG. 3. The locking screw 34 extends through a hole in one of the side walls of the vertical frame element 3 and through a hole in the bottom of the locking rail and is screwed into a threaded hole in the opposite side wall of the frame element.

I claim:

1. A sign post comprising vertically and horizontally extending hollow frame elements which are mutually connected so as to form one or more compartments for signboards, each horizontal frame element at each end thereof including a securing member, each of said securing members including a foot inserted into and secured in the end of the corresponding horizontal frame element and a crosspiece connected thereto by means of a body part having a width smaller than the width of said crosspiece so as to form recesses between said foot and the ends of said crosspiece extending laterally with respect to said body part; each vertical frame element having a number of openings in a side wall thereof and corresponding to the number of horizontal frame elements of said sign post, each of said openings having generally the same shape as the cross section of each of the crosspieces of said securing members so as to receive one of said crosspieces in each of said openings; a locking rail being movably arranged in each of said vertical frame elements, each of said locking rails being provided in one side thereof with a number of openings corresponding to the number of openings in the corresponding vertical frame element, each of said openings in said locking rail consisting of a first part having generally the same shape as the openings in the side wall of said vertical frame element, and a second opening part extending vertically from the top of said first opening part and having a width generally corresponding to the width of the body parts of said securing members and a height at least corresponding to the height of said body part, each of said locking rails, moreover, comprising wedge-shaped cam means, one provided along each side of each of said vertically extending second opening parts and with the smaller ends of said cam means pointing towards the laterally extending upper edges of said first opening parts, each of said wedge-shaped cam means having a thickness at the blunt end of each cam means which exceeds the width of said recesses in said securing members, each of said locking rails being movable in the longitudinal direction of the corresponding vertical frame element with said side of said rail, wherein said openings of said rail are provided in sliding contact with the inner surface of said wall of the corresponding vertical frame element wherein said openings of said vertical frame element are provided, each of said locking rails, moreover, being movable from a position in which said first opening parts of said openings in said locking rail register with said wall openings and to a position wherein said cam means of said locking rail engage said recesses in said securing members.

2. The sign post of claim 1, wherein said recesses have a tapering corresponding to the tapering of said cam means.

3. A sign post according to claim 1, wherein each of said horizontal frame elements has a longitudinally extending slot in the oppositely arranged side walls of said horizontal frame elements, strip formed board fasteners being provided in each of said slot and each strip comprising a groove for engaging the adjacent edge of a signboard and a body shaped for being accommodated in the corresponding slot, the groove of each strip being provided in a part of the strip projecting from the corresponding slot in the mounted position of said sign post.

* * * * *